US007036904B2

(12) United States Patent
King et al.

(10) Patent No.: US 7,036,904 B2
(45) Date of Patent: May 2, 2006

(54) PRINTHEAD SWATH HEIGHT MEASUREMENT AND COMPENSATION FOR INK JET PRINTING

(75) Inventors: David Golman King, Shelbyville, KY (US); Colin Geoffrey Maher, Georgetown, KY (US); Stephen Todd Olson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 206 days.

(21) Appl. No.: 10/699,551

(22) Filed: Oct. 30, 2003

(65) Prior Publication Data

US 2005/0093900 A1 May 5, 2005

(51) Int. Cl.
*B41J 29/393* (2006.01)

(52) U.S. Cl. ..... 347/19

(58) Field of Classification Search ..... 347/14, 347/19, 15, 86; 358/1.2, 1.9, 504
See application file for complete search history.

(56) References Cited

U.S. PATENT DOCUMENTS 5,600,350 A 2/1997 Cobbs et al.
5,825,378 A 10/1998 Beauchamp
5,835,108 A 11/1998 Beauchamp et al.
6,069,709 A 5/2000 Harrington
6,137,592 A * 10/2000 Arquilevich et al. ..... 581/1.8
6,145,959 A 11/2000 Lund et al.
6,196,652 B1 3/2001 Subirada et al.
6,247,786 B1 6/2001 Booth et al.
6,296,343 B1 10/2001 Alfaro
6,310,340 B1 10/2001 Rettinghaus
6,336,702 B1 1/2002 Zapata et al.
6,357,850 B1 3/2002 Liu
6,471,322 B1 * 10/2002 Kanda et al. ..... 347/15
6,508,535 B1 1/2003 Klassen
6,523,936 B1 2/2003 Zapata et al.
6,533,393 B1 3/2003 Meyer et al.
6,547,370 B1 4/2003 Mantell et al.
6,685,290 B1 * 2/2004 Farr et al. ..... 347/7
6,755,499 B1 * 6/2004 Castano et al. ..... 347/19
6,857,731 B1 * 2/2005 Tham ..... 347/86

* cited by examiner

*Primary Examiner*—Lamson Nguyen
(74) *Attorney, Agent, or Firm*—Taylor & Aust, P.C.

(57) ABSTRACT

A method that provides printhead swath height measurement and compensation includes the steps of establishing a nominal printhead swath height to be associated with printheads of a particular type; printing a swath using a first printhead of the particular type; measuring a printhead swath height of the first printhead; determining a difference between the measured printhead swath height of the first printhead and the nominal printhead swath height; generating a printhead swath height correction value based on the difference; and storing the printhead swath height correction value in a printhead memory associated with the first printhead.

33 Claims, 3 Drawing Sheets

PRINTHEAD SWATH HEIGHT MEASUREMENT AND COMPENSATION FOR INK JET PRINTING

BACKGROUND OF THE INVENTION

1. Field of the Invention

The present invention relates to ink jet printer, and, more particularly, to printhead swath height measurement and compensation.

2. Description of the Related Art

An ink jet printer forms an image on a print media sheet by ejecting ink from an ink jet printhead. Typically, the ink jet printhead includes at least one columnar nozzle array made up of a plurality of individually selectable ink jetting nozzles that eject ink to form a pattern of ink dots on the print media sheet. Such an ink jet printer may include a reciprocating printhead carrier that transports one or more ink jet printheads across the print media sheet along a bi-directional scanning path defining a print zone of the printer. Typically, a mid-frame provides media support at or near the print zone. A sheet feeding mechanism is used to incrementally advance the print media sheet in a sheet feed direction, also commonly referred to as a sub-scan direction or vertical direction, through the print zone between scans in the main scan direction, or after all data intended to be printed with the print media sheet at a particular stationary position has been completed. Also, typically, the columnar arrays of nozzles of the ink jet printhead, when mounted to the printhead carrier, extend in a direction parallel to the sheet feed direction.

For a given stationary position of the print media sheet, printing may take place during one or more unidirectional scans of the printhead carrier. The term, unidirectional, often is used to refer to scanning in either, but only one, of the two bi-directional scanning directions. Thus, bi-directional scanning refers to two successive unidirectional scans in opposite directions.

The term, swath, refers to the area on the print medium traced by the printhead during a particular unidirectional scan of the printhead carrier where ink may be deposited. Thus, during the printing of a swath, individual printhead nozzles of the columnar nozzle array(s) trace along imaginary rasters spaced apart in the sheet feed direction and eject ink to form a printed pattern, such as for example printed lines, each line being formed by a plurality of ink dots. The swath height of a swath is determined, at least in part, by the extent of the columnar array of nozzles in the sheet feed direction, e.g., the distance between the top-most nozzle and the lower-most nozzle of the columnar nozzle array used in printing the swath.

Those working in the imaging arts continually strive to improve the print quality of imaging devices, such as ink jet printers. One such attempt is directed to reducing the occurrence of horizontal banding defects in printouts generated by an ink jet printer. Horizontal banding defects may be observed on print media, such as paper, as a horizontal white band. Such defects may be attributable to errors generated by the media sheet indexing mechanism that is used to advance a media sheet in a media feed direction through the printer during the printing of the text or image on the media sheet. Such errors can be caused, for example, by mechanical tolerances of the index roller and its associated drive train. It is known to mask such indexing errors by adopting an interlaced printing method, also referred to as shingling, wherein each scan of the printhead carrier (also sometimes referred to in the art as a printhead carriage) is made to vertically overlap a preceding scan. For a given swath, only a portion of the total print data for a given area on the print medium is printed. Thus, each scan of an actuated printhead produces a swath of printed output forming all or portions of multiple print lines, and multiple swaths may be required to complete the printing of any given print line.

Also, it has been recognized that banding effects may arise due to inaccuracies of the orientation or position of certain nozzles, particularly printheads manufactured using tape automated bonding ("TAB") nozzle arrays. These effects may occur due to a concentration of aiming errors at the ends of the nozzle arrays, typically outboard-aimed nozzles as distinguished from the great majority of more centrally disposed nozzles. Some printers provide a built-in algorithmically operated automatic measurement of the effective increase of the pixel-swath dimension. This is followed by automatic adjustment of the printing-medium advance, typically extending the advance stroke by about half the extension of the swath dimension. However, such error is not always outboard and the swath-dimension change sometimes may be a contraction. Accordingly, the print-medium advance stroke may be shortened rather than lengthened.

One disadvantage of such a known in-printer approach is that the in-printer measuring system may lack sufficient accuracy and precision to properly compensate for swath height variations due to manufacturing variations in the nozzle spacings along the longitudinal extent of the columnar array of nozzles, from one printhead to another.

What is needed in the art is printhead swath height measurement and compensation for ink jet printing that addresses the shortcomings identified above.

SUMMARY OF THE INVENTION

The present invention provides printhead swath height measurement and compensation for ink jet printing.

In one form thereof, the present invention is directed to a method for providing printhead swath height measurement and compensation, including the steps of establishing a nominal printhead swath height to be associated with printheads of a particular type; printing a swath using a first printhead of the particular type; measuring a printhead swath height of the first printhead; determining a difference between the measured printhead swath height of the first printhead and the nominal printhead swath height; generating a printhead swath height correction value based on the difference; and storing the printhead swath height correction value in a printhead memory associated with the first printhead.

In another form thereof, the present invention is directed to a method for providing printhead swath height measurement and compensation, including the steps of providing a printhead, the printhead including a printhead memory and a columnar array of N nozzles, individually identifiable as nozzle 1 to nozzle N; printing a swath using at least nozzle 1 and nozzle N of the printhead to form a plurality of substantially parallel lines, including a first line printed by the nozzle 1 and an Nth line printed by the nozzle N; measuring a printhead swath height of the printhead by measuring a distance between the first line and the Nth line; determining a difference between the measured printhead swath height and a nominal printhead swath height; generating a printhead swath height correction value based on the difference between the measured printhead swath height and the nominal printhead swath height; and storing the printhead swath height correction value in the printhead memory.

In still another form thereof, the present invention is directed to an ink jet printer, including a printhead, a feed roller unit and a controller. The printhead includes a printhead memory having stored therein a printhead swath height correction value. A feed roller unit includes a feed roller controllable to index a print media sheet in a sheet feed direction by a plurality of media advance distances, including a nominal media advance distance. The controller is communicatively coupled to the printhead and communicatively coupled to the feed roller unit. The controller executes process steps to retrieve the printhead swath height correction value from the printhead memory. The controller uses the printhead swath height correction value to modify the nominal media advance distance to establish a modified media advance distance for use with the feed roller unit when printing with the printhead.

In yet another form thereof, the present invention is directed to a printing system. The printing system includes a computer that executes instructions for formatting image data. An ink jet printer is communicatively coupled to the computer. The ink jet printer includes a controller communicatively coupled to a printhead. The printhead includes a printhead memory having stored therein a printhead swath height correction value. The controller executes process steps to retrieve the printhead swath height correction value from the printhead memory and to forward the printhead swath height correction value to the computer. The computer modifies a format of image data for use when printing with the printhead.

One advantage of the present invention is that it may be implemented for use during the printhead and/or printhead cartridge manufacturing process, where precision instruments may be used to make measurements in a controlled environment.

Another advantage of the present invention is that by storing a printhead swath height correction value in printhead memory, the printhead swath height correction value may be used with each printer in which the printhead is installed, without having to repeat the printhead swath height correction value determination process for each printer.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
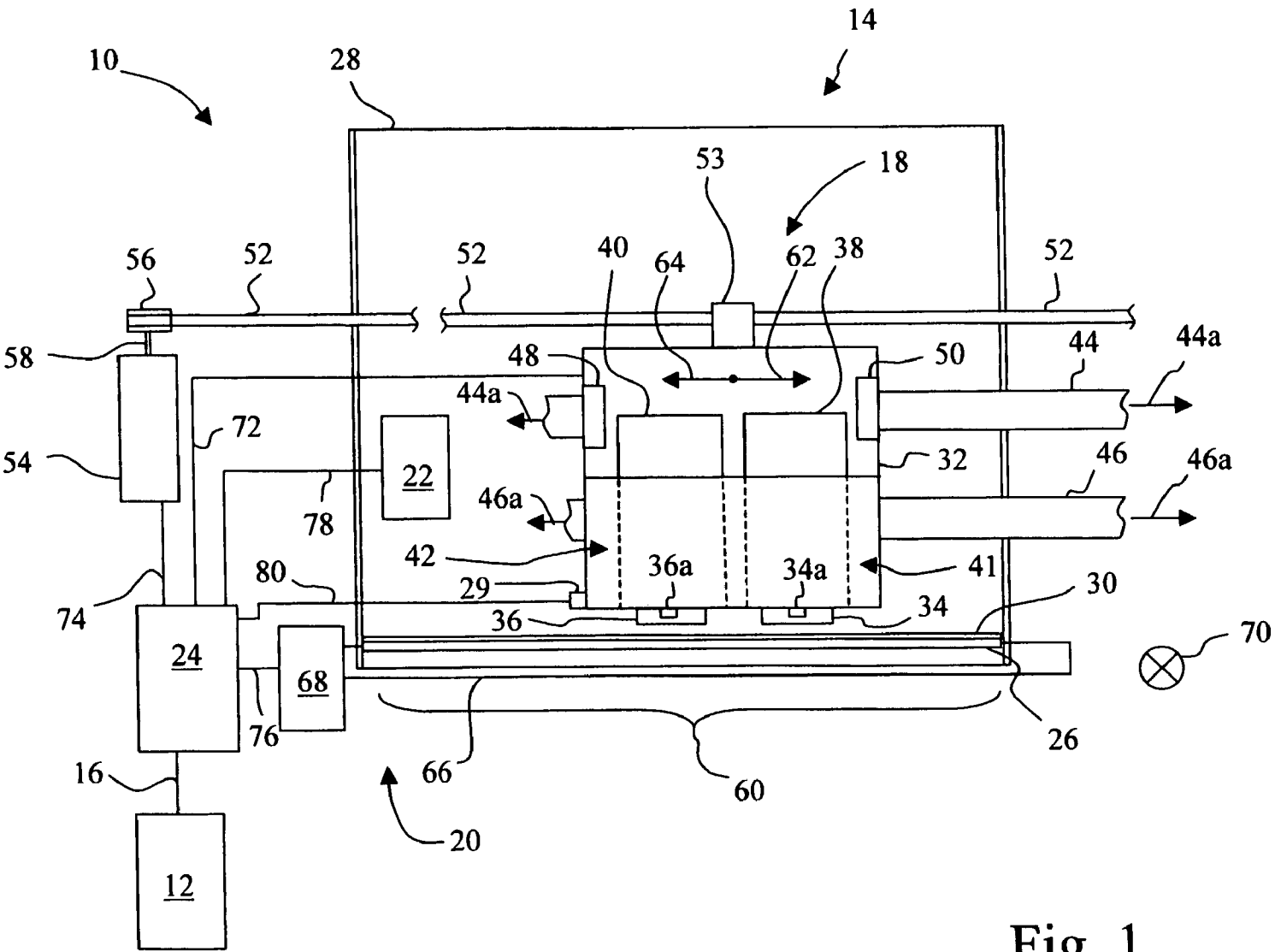
FIG. 1 is a diagrammatic representation of an ink jet printer that may utilize the present invention.

Referring now to the drawings, and particularly to FIG. 1, there is shown an imaging system 10 for utilizing the present invention. Imaging system 10 includes a computer 12 and an ink jet printer 14. Computer 12 is communicatively coupled to ink jet printer 14 via a communications link 16. Communications link 16 may be, for example, a direct electrical or optical connection, or a network connection.

Ink jet printer 14 includes a printhead carrier system 18, a feed roller unit 20, a sheet picking unit 22, a controller 24, a mid-frame 26, a media source 28, and a sensor 29.

Computer 12 may be, for example, a personal computer including a display device, an input device (e.g., keyboard), a processor, input/output (I/O) interfaces, memory, such as RAM, ROM, NVRAM, and a mass data storage device, such as a hard drive, CD-ROM and/or DVD units. During operation, computer 12 includes in its memory a software program including program instructions that function as a printer driver for ink jet printer 14. The printer driver is in communication with controller 24 of ink jet printer 14 via communications link 16. The printer driver, for example, includes a halftoning unit and a data formatter that places image data (also sometimes referred to as print data) and print commands in a format that can be recognized and used by ink jet printer 14. In a network environment, communications between computer 12 and ink jet printer 14 may be facilitated via a standard communication protocol, such as the Network Printer Alliance Protocol (NPAP).

Media source 28 is configured to receive a plurality of print media sheets from which a print medium, e.g., a print media sheet 30, is picked by sheet picking unit 22 and transported to feed roller unit 20, which in turn further transports print media sheet 30 during a printing operation. Print media sheet 30 can be, for example, plain paper, coated paper, photo paper or transparency media.

Printhead carrier system 18 includes a printhead carrier 32 for mounting, for example, sensor 29, a color printhead 34 and a monochrome printhead 36.

Sensor 29 may be used to perform a variety of sensing functions. For example, sensor 29 may be used in performing printhead alignment. Also, sensor 29 may be used to differentiate between various types of media, such as for example, to differentiate between a transparency media sheet and a plain paper media sheet. Sensor 29 may be a unitary optical sensor including, for example, a light source, a specular detector and/or a diffuse detector, each positioned to establish an angle of incidence, i.e., an angle of reflection, with respect to the plane of a sheet of print media, such as print media sheet 30. In its simplest form, the light source may include, for example, a light emitting diode (LED). In a more complex form, the light source may further include additional optical components for generating a collimated light beam. The specular and/or diffuse detectors may be, for example, a phototransistor whose voltage, or current, output varies as a function of the intensity of the reflected light that it receives. Further, it is contemplated that sensor 29 may be formed as a CCD or CIS scan bar, as is common on multifunction imaging devices having a built-in scan/copy function.

As indicated above, in the embodiment shown in FIG. 1, printhead carrier 32 is configured to mount color printhead 34 and monochrome printhead 36. A color ink reservoir 38, containing for example, one or more chromatic inks, such as cyan, magenta and yellow, is provided in fluidic communication with color printhead 34, and a monochrome ink reservoir 40, containing for example an achromatic ink, such as black, is provided in fluidic communication with monochrome printhead 36. Those skilled in the art will recognize that color printhead 34 and color ink reservoir 38 may be formed as individual discrete units, or may be combined as an integral unitary printhead cartridge 41. Likewise, monochrome printhead 36 and monochrome reservoir 40 may be formed as individual discrete units, or may be combined as an integral unitary printhead cartridge 42.

Each of printheads 34, 36 have associated therewith a respective memory 34*a*, 36*a*. Memory 34*a* may be formed as a portion of the substrate forming color printhead 34, or alternatively, may be attached to color ink reservoir 38. Memory 36*a* may be formed as a portion of the substrate forming monochrome printhead 36, or may be attached to monochrome ink reservoir 40.

In the embodiment shown in FIG. 1, printhead carrier 32 is guided by a pair of guide members 44, 46, such as guide rods. Each of guide members 44, 46 includes a respective horizontal axis 44*a*, 46*a*. Printhead carrier 32 may include a pair of guide rod bearings 48, 50, each of guide rod bearings 48, 50 including a respective aperture for receiving guide member 44. Printhead carrier 32 further includes a glide surface (not shown) that is retained in contact with guide member 46, for example, by gravitational force, or alternatively, by another guide rod bearing or bearing set. The horizontal axis 44*a* of guide member 44 generally defines a bi-directional scanning path for printhead carrier 32, and thus, for convenience the bi-directional scanning path will be referred to as bi-directional scanning path 44*a*. Accordingly, bi-directional scanning path 44*a* is associated with each of printheads 34, 36.

Printhead carrier 32 is connected to a carrier transport belt 52 via a carrier drive attachment device 53. Carrier transport belt 52 is driven by a carrier motor 54 via a carrier pulley 56. Carrier motor 54 has a rotating carrier motor shaft 58 that is attached to carrier pulley 56. At the directive of controller 24, printhead carrier 32 is transported in a reciprocating manner along guide members 44, 46. Carrier motor 54 can be, for example, a direct current (DC) motor or a stepper motor.

The reciprocation of printhead carrier 32 transports ink jet printheads 34, 36 across the print media sheet 30, such as paper, along bi-directional scanning path 44*a* to define a print zone 60 of ink jet printer 14. The reciprocation of printhead carrier 32 occurs in a main scan direction (bi-directional) that is parallel with bi-directional scanning path 44*a*, and is also commonly referred to as the horizontal direction, including a left-to-right carrier scan direction 62 and a right-to-left carrier scan direction 64. Generally, during each scan of printhead carrier 32 while printing, the print media sheet 30 is held stationary by feed roller unit 20.

Mid-frame 26 provides support for the print media sheet 30 when the print media sheet 30 is in print zone 60, and in part, defines a portion of a print media path of ink jet printer 14.

Feed roller unit 20 includes a feed roller 66 and corresponding index pinch rollers (not shown). Feed roller 66 is driven by a drive unit 68. The index pinch rollers apply a biasing force to hold the print media sheet 30 in contact with respective driven feed roller 66. Drive unit 68 includes a drive source, such as a stepper motor, and an associated drive mechanism, such as a gear train or belt/pulley arrangement. Feed roller unit 20 feeds the print media sheet 30 in a sheet feed direction 70, designated as an X in a circle to indicate that the sheet feed direction is out of the plane of FIG. 1 toward the reader. The sheet feed direction 70 is commonly referred to as the vertical direction, which is perpendicular to the horizontal bi-directional scanning path 44*a*, and in turn, perpendicular to the horizontal carrier scan directions 62, 64. Thus, with respect to print media sheet 30, carrier reciprocation occurs in a horizontal direction and media advance occurs in a vertical direction, and the carrier reciprocation is generally perpendicular to the media advance.

Controller 24 includes a microprocessor having an associated random access memory (RAM) and read only memory (ROM). Controller 24 executes program instructions to effect the printing of an image on the print media sheet 30, such as for example, by selecting the indexed media feed distance of print media sheet 30 along the print media path as conveyed by feed roller 66, controlling the reciprocation of printhead carrier 32, and controlling the operations of printheads 34, 36.

Controller 24 is electrically connected and communicatively coupled to printheads 34, 36 via a communications link 72, such as for example a printhead interface cable. Controller 24 is electrically connected and communicatively coupled to carrier motor 54 via a communications link 74, such as for example an interface cable. Controller 24 is electrically connected and communicatively coupled to drive unit 68 via a communications link 76, such as for example an interface cable. Controller 24 is electrically connected and communicatively coupled to sheet picking unit 22 via a communications link 78, such as for example an interface cable. Controller 24 is electrically connected and communicatively coupled to sensor 29 via a communications link 80, such as for example an interface cable.

When a new printhead, such as one or both of printheads 34, 36, is first installed in ink jet printer 14, controller 24 executes a routine to retrieve from the respective memory 34*a*, 36*a* a corresponding printhead swath height correction value. The swath height correction value that is stored in the printhead memory was previously determined, such as in a manner described below, based on a difference between a measured printhead swath height for that particular printhead and a nominal printhead swath height. The printhead swath height correction value is used to modify a nominal media advance distance associated with ink jet printer 14 to establish a modified media advance distance for use in printing with that particular printhead. The nominal media advance distance may be, for example, a default media advance distance established for ink jet printer 14. The nominal media advance distance may be dependent, for example, upon the shingling algorithm used in printing an image.

For example, assume that color printhead 34 is newly installed in ink jet printer 14. Controller 24 executes process steps to retrieve from memory 34*a* the printhead swath height correction value associated with color printhead 34. Controller 24 then uses the printhead swath height correction value associated with color printhead 34 to modify a nominal media advance distance associated with feed roller unit 20 of ink jet printer 14 to establish a modified media advance distance for use in printing with printhead 34.

As a more specific example, if the measured printhead swath height is greater than the nominal printhead swath height by a predetermined amount, then the modified media advance distance is established to be greater than the nominal media advance distance. Thus, if the measured printhead swath height is greater than the nominal printhead swath height by no more than 10 microns, for example, then a compensation factor used to modify the nominal media advance distance may be set to zero. If, however, the measured printhead swath height is greater than the nominal printhead swath height by between 10 microns and 20 microns, then a compensation factor used to modify said nominal media advance distance may be set to +15 microns, for example.

As another specific example, if the measured printhead swath height is less than the nominal printhead swath height by a predetermined amount, then the modified media advance distance is established to be less than the nominal media advance distance. Thus, if the measured printhead swath height is less than the nominal printhead swath height by 10 microns or less, for example, then a compensation factor used to modify the nominal media advance distance may be set to zero. If, however, the measured printhead swath height is less than the nominal printhead swath height by between 10 microns and 20 microns, then a compensation factor used to modify the nominal media advance distance is set to −15 microns, for example.

In an alternative embodiment, controller 24 may execute process steps to retrieve the printhead swath height correction value from the printhead memory, such as for example printhead memory 36*a* of monochrome printhead 36. Controller 24 then forwards the retrieved printhead swath height correction value to computer 12. In turn, computer 12 modifies a format of the image data for use when printing with that particular printhead, i.e., in this example, printhead 36.

Figure 2:
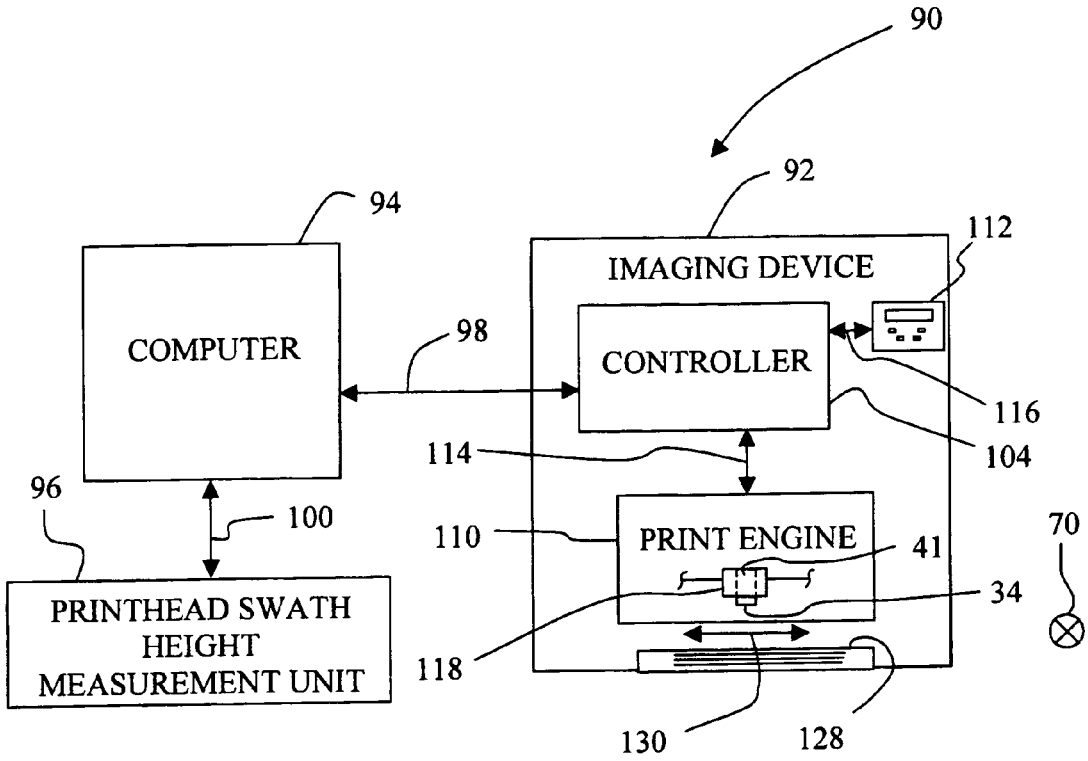
FIG. 2 is a diagrammatic representation of a printhead swath height measurement and compensation system in accordance with present invention.

Referring now FIG. 2, there is shown a diagrammatic representation of a printhead swath height measurement and compensation system 90 for use in implementing the present invention. System 90 is located, for example, in a printhead manufacturing area for facilitating printhead swath height measurement and compensation for each production printhead tested. The production printhead may be, for example, attached to an ink reservoir to form a unitary printhead cartridge. The invention will now be described with respect to one such production printhead, and more particularly, with respect to color printhead cartridge 41 that includes color printhead 34 and printhead memory 34*a*.

System 90 includes an imaging device 92 and a computer 94, and a printhead swath height measurement unit 96.

Imaging device 92 communicates with computer 94 via a communications link 98. Communications link 98 may be established by a direct cable connection, wireless connection or by a network connection such as for example an Ethernet local area network (LAN).

Printhead swath height measurement unit 96 communicates with computer 94 via a communications link 100. Communications link 100 may be established by a direct cable connection, wireless connection or by a network connection such as for example an Ethernet local area network (LAN). Printhead swath height measurement unit 96 may be, for example, a calibrated microscope having automatic digital image capture, preferably having an accuracy in the range of ±5 micrometers or less, which in turn sends the printhead swath measurement to computer 94 for processing.

Imaging device 92 can be, for example, an ink jet printer configured using precision components to emulate a particular ink jet printer model, such as for example, ink jet printer 14 described above. Imaging device 92 includes a controller 104, an ink jet print engine 110 and a user interface 112.

Computer 94 includes a processor, input/output (I/O) interfaces, memory, such as RAM, ROM, NVRAM, and a mass data storage device, such as a hard drive, CD-ROM and/or DVD units. During operation, computer 94 includes in its memory a software program including program instructions that function as an imaging driver, e.g., printer driver software, for imaging device 92. The imaging driver is in communication with controller 104 of imaging device 92 via communications link 98 to provide formatted image data to imaging device 92, and more particularly, to print engine 110. In addition, computer 94 executes program instructions to facilitate the acquisition of a printhead swath height of each tested production printhead, such as printhead 34, from printhead swath height measurement unit 96, and to establish a printhead swath height correction value for the printhead, which in turn will be stored in the printhead memory, e.g., printhead memory 34*a*.

Controller 104 of imaging device 92 includes a processor unit and associated memory, and may be formed as an Application Specific Integrated Circuit (ASIC). Controller 104 communicates with print engine 110 via a communications link 114. Controller 104 communicates with user interface 112 via a communications link 116. Communications links 114 and 116 may be established, for example, by using standard electrical cabling or bus structures, or by wireless connection.

Print engine 110 is configured and operates in accordance with the description of ink jet printer 14 described above, and thus, may include a reciprocating printhead carrier 118, similar to printhead carrier 32 of ink jet printer 14, that carries at least one ink jet production printhead, such as exemplary color printhead 34, and may be mechanically and electrically configured to mount, carry and facilitate one or more unitary printhead cartridges, such as color printhead cartridge 41. Hereinafter, the printhead swath height measurement and compensation method in accordance with this embodiment of the present invention will be described with reference to color printhead 34.

Figure 3:
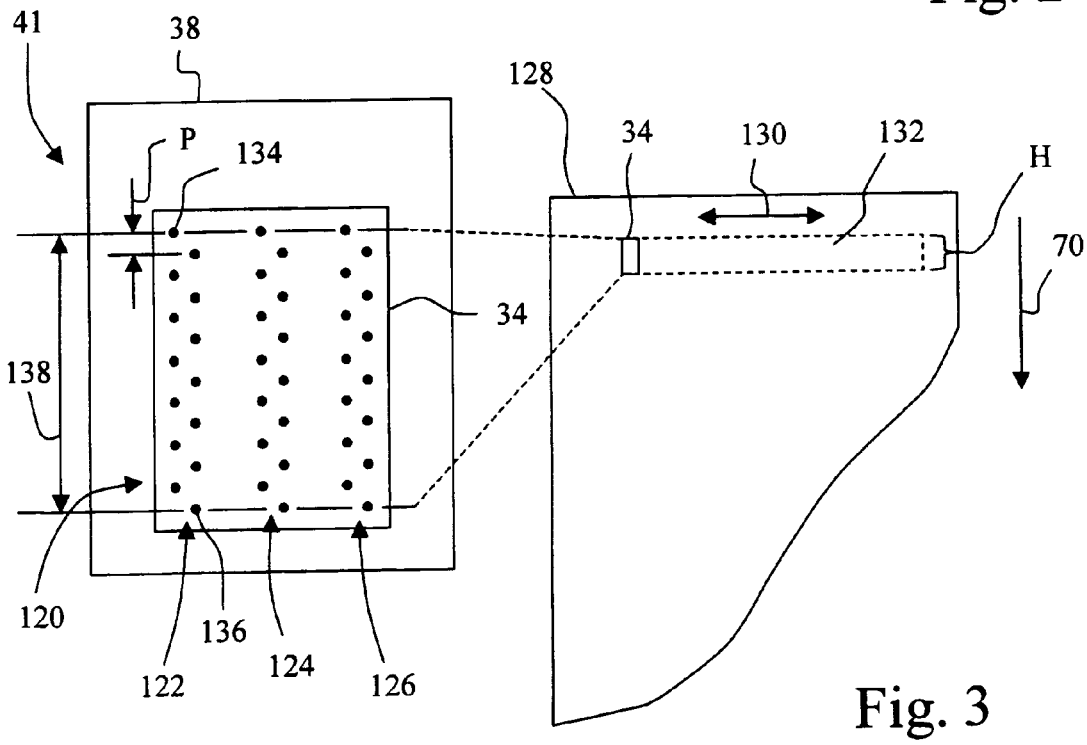
FIG. 3 is a diagrammatic representation of a printhead that forms a swath on a print media sheet.

Referring to FIG. 3, color printhead 34 includes a plurality of columnar nozzle arrays 120, as shown, or alternatively, may include a single columnar nozzle array.

In FIG. 3, there is shown a bottom view of unitary printhead cartridge 41 including color printhead 34. Color printhead 34 is shown in magnified and exaggerated form for clarity and ease of understanding of its description that follows. Individual ink jetting nozzles for color printhead 34 are represented by dots, but the number of nozzles depicted are for exemplary purposes only, and it is to be understood that the number of nozzles for a particular printhead may be dependent on design constraints associated with the printhead and/or the printer in which the printhead will be used. Color printhead 34 may include, for example, a total of 480 nozzles divided into three nozzle arrays including 160 nozzles each. A vertical spacing between two consecutive nozzles is referred to as a nozzle pitch P.

As shown in FIG. 3, color printhead 34 includes a plurality of nozzle arrays 120, such as for example, a magenta nozzle array 122, a cyan nozzle array 124 and a yellow nozzle array 126. Magenta nozzle array 122 is coupled in fluidic communication with an ink chamber that contains a magenta ink. Cyan nozzle array 124 is coupled in fluidic communication with an ink chamber that contains a cyan ink. Yellow nozzle array 126 is coupled in fluidic communication with an ink chamber that contains a yellow ink. Nozzle arrays 122, 124, and 126 are arranged to be substantially parallel and in horizontal registration, and are arranged to be substantially parallel to sheet feed direction 70 when color printhead 34 is mounted in printhead carrier 32 of ink jet printer 14, or alternatively, when mounted in printhead carrier 118 of imaging device 92.

Printhead swath height measurement and compensation system 90 establishes certain nominal values that will be used as standards. For example, print engine 110 is configured to establish a predefined nominal gap between color printhead 34 and a print media sheet 128. Further, print engine 110 is configured to provide a predefined nominal carrier scan speed for printhead carrier 118. The nominal printhead gap and the nominal carrier scan speed are defined for an ideal printer corresponding to the ink jet printers on which the printheads to be tested may ultimately be mounted, such as for example, ink jet printer 14.

Further, each printhead of a particular type, such as color printhead 34, will have a predefined nominal printhead nozzle spacing (NPSH) corresponding to an ideal nozzle pitch (INP), and wherein a nominal printhead swath height is defined by the equation: NPSH=INP X (N), wherein N represents the number of nozzles in the columnar array. For example, if a particular columnar array, such as, cyan nozzle array 124, has a total number of 160 nozzles (N=160) and the ideal nozzle pitch is $1/600^{th}$ of an inch (approximately 42.3 microns), then the nominal printhead swath height for cyan nozzle array 124 is $160/600$ths of an inch (approximately 6.7 millimeters), and if the nominal values for magenta nozzle array 122 and yellow nozzle array 126 are the same as cyan nozzle array 124, then the calculated nominal printhead swath height may be considered to be representative of the printhead swath height of color printhead 34.

Referring to FIGS. 2 and 3, printhead carrier 118 is controlled by controller 104 to move the mounted ink jet printhead to be tested, i.e., color printhead 34, in a reciprocating manner along a bi-directional scan path 130, which may also be referred to as horizontal direction 130. Bi-directional scan path 130, i.e. the horizontal direction, is substantially perpendicular to sheet feed direction 70 (i.e., vertical direction with respect to print media sheet 128). Printhead 34 is transported over print medium 128 to form a swath, such as for example, swath 132 as shown.

Referring now, for example, to columnar magenta nozzle array 122 of printhead 34, magenta nozzle array 122 includes a plurality of N nozzles. Magenta nozzle array 122 may include, for example, both large nozzles and small nozzles arranged in a staggered manner, or may include other nozzle arrangements known in the art. The N nozzles of magenta nozzle array 122 of color printhead 34 includes a first nozzle 134 (e.g., uppermost) and an Nth nozzle 136 (e.g., lowermost). Each ink drop expelled, or to be expelled, from each of the N nozzles forms a dot on the print media sheet 128. A printhead swath height (H) of printhead 34 corresponds to the distance 138 between the uppermost first nozzle 134 and lowermost Nth nozzle 136 of color printhead 34, or may, as shown, correspond to the distance between the uppermost and lowermost nozzles of and individual one of the plurality of nozzle arrays 120, such as magenta nozzle array 122.

The swath height determination for color printhead 34 may be correlated to a particular columnar nozzle array of the plurality of columnar nozzle arrays 120, and thus, may be repeated for each individual columnar nozzle array of color printhead 34 to determine a separate swath height for each color of ink. In other words, a respective swath height determination may be made for each of columnar nozzle arrays 122, 124, 126.

Alternatively, one nozzle array of the plurality of nozzle arrays 120 may be selected as the representative nozzle array for determining the printhead swath height of color printhead 34. For example, the center cyan nozzle array 124 may be selected to be the representative nozzle array for swath height determination for color printhead 34 due to its central location in printhead 34. As another example, the magenta nozzle array 122 may be selected to be the representative nozzle array for swath height determination for color printhead 34 due to its being the darkest of the colors for color printhead 34.

As another alternative, it is possible to simultaneously print with all of the plurality of nozzle arrays 120 to generate a composite swath representative of color printhead 34. Such a composite swath will take into account the situation wherein the plurality of nozzle arrays are not in registration in the vertical dimension. For example, it is possible that the uppermost nozzle and the lowermost nozzle of color printhead 34 may be located in a different columnar nozzle array of the plurality of columnar nozzle arrays 120, in which case the swath height for printhead 34 may differ from any individual swath height generated by only one of the plurality of nozzle arrays 120.

Figure 4:
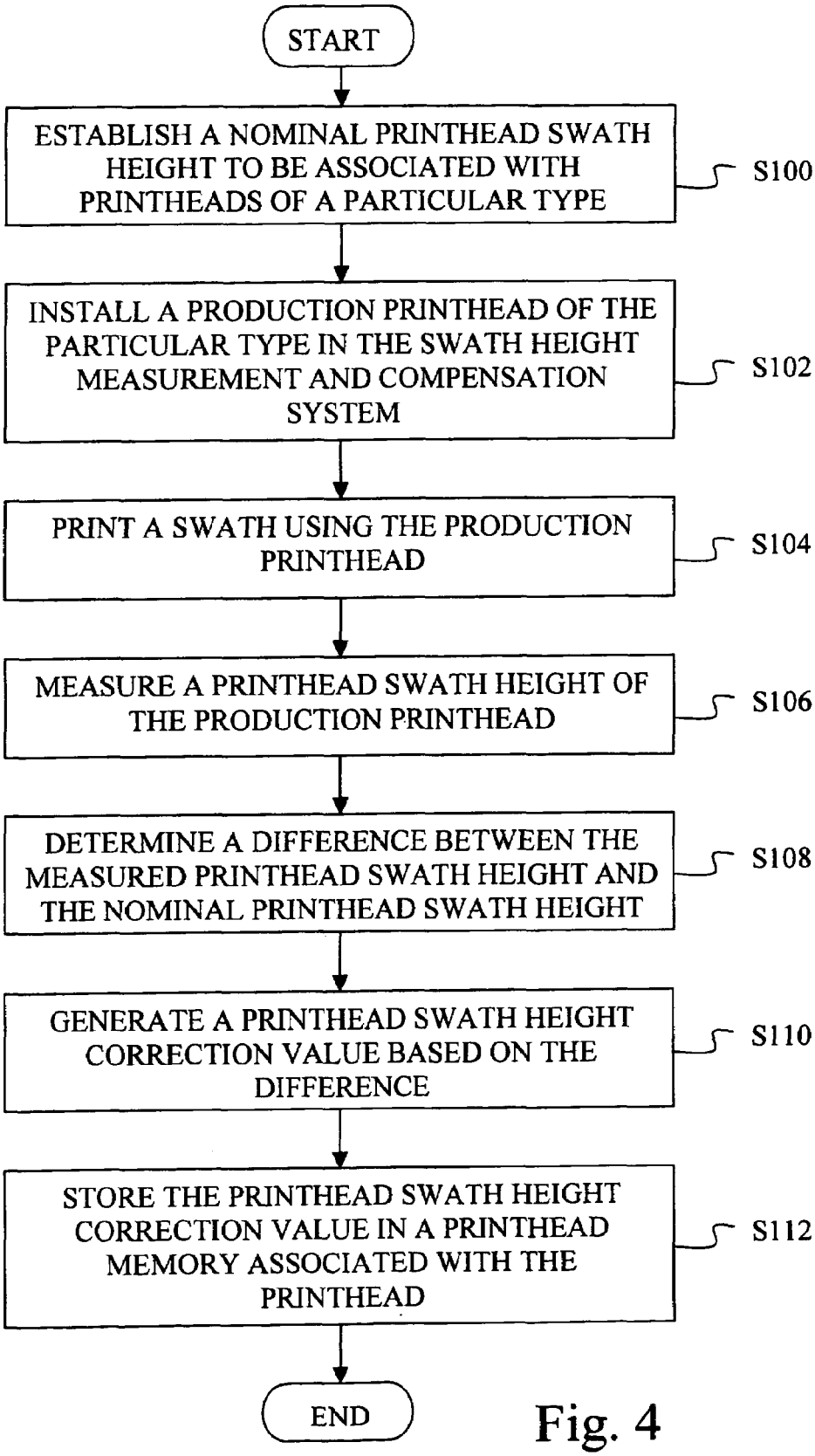
FIG. 4 is a general flowchart of an exemplary process for printhead swath height measurement and compensation in accordance with the present invention.

FIG. 4 is a flowchart of an exemplary process for printhead swath height measurement and compensation in accordance with the present invention, and will be described with respect to FIGS. 2 and 3. In one implementation of the process of FIG. 4, which is preferred, the process is performed at the printhead manufacturing facility. The description that follows will be with reference to color printhead 34, although those skilled in the art will recognize that the process can be used with monochrome printhead 36, or any other type of similar printhead.

At step S100, a nominal printhead swath height to be associated with production printheads of a particular type is established. The particular type may be, for example, a color printhead, such as color printhead 34, or a monochrome printhead, such as monochrome printhead 36. As another example, the particular type may be printheads that include the same number of nozzles in a columnar array and have the same nozzle pitch between vertically spaced nozzles.

At step S102, the production printhead, such as color printhead 34, is installed in printhead swath height measurement and compensation system 90, and more particularly, is installed in printhead carrier 118 of print engine 110.

At step S104, printhead 34 is scanned across the print media sheet 128 under the control of controller 104 to print a swath 132 on print media sheet 128.

At step S106, a printhead swath height of color printhead 34 is measured by measuring the printhead swath height H of swath 132 formed on print media sheet 128. This measurement may occur, for example, by printhead swath height measurement unit 96 having a calibrated microscope with automatic digital image capture, which in turn sends the printhead swath measurement to computer 94 for processing.

At step S108, computer 94 determines a difference between the measured printhead swath height H and the nominal printhead swath height. The difference may be positive, indicating printhead nozzle array expansion with respect to the nominal printhead swath height, or may be negative, indicating printhead nozzle array compression with respect to the nominal printhead swath height.

At step S110, computer 94, or alternatively controller 104 generates a printhead swath height correction value based on the difference between the measured printhead swath height H and the nominal printhead swath height.

At step S112, the printhead swath height correction value is stored in printhead memory 34*a* associated with color printhead 34. Printhead memory 34*a* may be formed on a substrate of color printhead 34. In an embodiment where color printhead 34 is combined with color ink reservoir 38 to form a printhead cartridge 41, printhead memory 34*a* may alternatively be mounted to ink reservoir 38.

Upon installation of color printhead 34 in ink jet printer 14 of FIG. 1, in one embodiment, controller 24 retrieves the printhead swath height correction value from printhead memory 34*a* and uses the printhead swath height correction value to modify a nominal media advance distance of ink jet printer 14 to establish a modified media advance distance. In another embodiment, controller 24 forwards the printhead swath height correction value to computer 12 for modification of an image data format of the image data provided by computer 12 to ink jet printer 14.

It is contemplated that the process of the present invention may be carried out on each printhead manufactured, or alternatively, may be selectively applied at fixed intervals, or randomly, to a portion of the manufactured printheads.

In another implementation of the process of FIG. 4, the process may be performed in the ink jet printer, such as ink jet printer 14, at the time of printhead installation. In such an implementation, measuring step S106 is performed using sensor 29, serving as an optical scanner, which in turn feeds the measured printhead swath height information to controller 104, which in turn performs steps S108, S110 and S112.

While this invention has been described with respect to particular embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for providing printhead swath height measurement and compensation, comprising the steps of:

establishing a nominal printhead swath height to be associated with printheads of a particular type;

printing a swath using a first printhead of said particular type;

measuring a printhead swath height of said first printhead;

determining a difference between the measured printhead swath height of said first printhead and said nominal printhead swath height;

generating a printhead swath height correction value based on said difference; and storing said printhead swath height correction value in a printhead memory associated with said first printhead.

2. The method of claim 1, said method being effected during printhead manufacture.

3. The method of claim 1, said measuring step being effected, at least in part, by using a calibrated microscope having a digital image capture mechanism for capturing a magnified image of said swath.

4. The method of claim 1, wherein said measuring step is effected by using an optical scanner.

5. The method of claim 1, wherein said nominal printhead swath height is defined by an ideal nozzle pitch multiplied by a number N of nozzles in a columnar array of said first printhead.

6. The method of claim 1, wherein said printhead swath height correction value is used to modify a nominal media advance distance of an ink jet printer to establish a modified media advance distance.

7. The method of claim 1, wherein said printhead memory is formed on a substrate of said first printhead.

8. The method of claim 1, wherein said first printhead is mounted to an ink reservoir to form a unitary printhead cartridge.

9. The method of claim 8, wherein said printhead memory is mounted to said ink reservoir.

10. The method of claim 1, further comprising the step of retrieving said printhead swath height correction value from said printhead memory and using said printhead swath height correction value to modify at least one of an image data format and a nominal media advance distance of an ink jet printer to establish a modified media advance distance.

11. A method for providing printhead swath height measurement and compensation, comprising the steps of:

providing a printhead, said printhead including a printhead memory and a columnar array of N nozzles, individually identifiable as nozzle 1 to nozzle N;

printing a swath using at least nozzle 1 and nozzle N of said printhead to form a plurality of substantially parallel lines, including a first line printed by said nozzle 1 and an Nth line printed by said nozzle N;

measuring a printhead swath height of said printhead by measuring a distance between said first line and said Nth line;

determining a difference between the measured printhead swath height and a nominal printhead swath height;

generating a printhead swath height correction value based on said difference between said measured printhead swath height and said nominal printhead swath height; and storing said printhead swath height correction value in said printhead memory.

12. The method of claim 11, said method being effected during manufacture of said first printhead.

13. The method of claim 12, said measuring step being effected, at least in part, by using a calibrated microscope having a digital image capture mechanism for capturing a magnified image of said swath.

14. The method of claim 12, wherein said measuring step is effected by using an optical scanner.

15. The method of claim 11, wherein said nominal printhead swath height is defined by an ideal nozzle pitch multiplied by (N).

16. The method of claim 11, wherein said printhead swath height correction value is used to modify a nominal media advance distance of an ink jet printer to establish a modified media advance distance.

17. The method of claim 16, wherein if said measured printhead swath height is greater than said nominal printhead swath height by a predetermined amount, then said modified media advance distance is established to be greater than said nominal media advance distance.

18. The method of claim 16, wherein if said measured printhead swath height is greater than said nominal printhead swath height by 10 microns or less, then a compensation factor used to modify said nominal media advance distance is set to zero.

19. The method of claim 16, wherein if said measured printhead swath height is greater than said nominal printhead swath height by between 10 microns and 20 microns, then a compensation factor used to modify said nominal media advance distance is set to +15 microns.

20. The method of claim 16, wherein if said measured printhead swath height is less than said nominal printhead swath height by a predetermined amount, then said modified media advance distance is established to be less than said nominal media advance distance.

21. The method of claim 16, wherein if said measured printhead swath height is less than said nominal printhead swath height by 10 microns or less, then a compensation factor used to modify said nominal media advance distance is set to zero.

22. The method of claim 16, wherein if said measured printhead swath height is less than said nominal printhead swath height by between 10 microns and 20 microns, then a compensation factor used to modify said nominal media advance distance is set to −15 microns.

23. The method of claim 11, wherein said measuring step is effected by printing said swath using said printhead and measuring a height of said swath using an optical scanner.

24. The method of claim 11, wherein said columnar array of N nozzles of said printhead jets a first color ink, said printhead including at least one other columnar array of nozzles for jetting ink of at least a second color ink different from said first color ink, said swath being printed using both said first color ink and said second color ink.

25. The method of claim 11, wherein said measuring step is effected in an ink jet printer in which said printhead is installed.

26. An ink jet printer, comprising:

a printhead, said printhead including a printhead memory having stored therein a printhead swath height correction value;

a feed roller unit including a feed roller controllable to index a print media sheet in a sheet feed direction by a plurality of media advance distances, including a nominal media advance distance; and a controller communicatively coupled to said printhead and communicatively coupled to said feed roller unit, said controller executing process steps to retrieve said printhead swath height correction value from said printhead memory, said controller using said printhead swath height correction value to modify said nominal media advance distance to establish a modified media advance distance for use with said feed roller unit when printing with said printhead.

27. The ink jet printer of claim 26, said printhead swath height correction value being based on a difference between a measured printhead swath height and a nominal printhead swath height, wherein if said measured printhead swath height is greater than said nominal printhead swath height by a predetermined amount, then said modified media advance distance is established to be greater than said nominal media advance distance.

28. The ink jet printer of claim 26, said printhead swath height correction value being based on a difference between a measured printhead swath height and a nominal printhead swath height, wherein if said measured printhead swath height is greater than said nominal printhead swath height by 10 microns or less, then a compensation factor used to modify said nominal media advance distance is set to zero.

29. The ink jet printer of claim 26, said printhead swath height correction value being based on a difference between a measured printhead swath height and a nominal printhead swath height, wherein if said measured printhead swath height is greater than said nominal printhead swath height by between 10 microns and 20 microns, then a compensation factor used to modify said nominal media advance distance is set to +15 microns.

30. The ink jet printer of claim 26, said printhead swath height correction value being based on a difference between a measured printhead swath height and a nominal printhead swath height, wherein if said measured printhead swath height is less than said nominal printhead swath height by a predetermined amount, then said modified media advance distance is established to be less than said nominal media advance distance.

31. The ink jet printer of claim 26, said printhead swath height correction value being based on a difference between a measured printhead swath height and a nominal printhead swath height, wherein if said measured printhead swath height is less than said nominal printhead swath height by 10 microns or less, then a compensation factor used to modify said nominal media advance distance is set to zero.

32. The ink jet printer of claim 26, said printhead swath height correction value being based on a difference between a measured printhead swath height and a nominal printhead swath height, wherein if said measured printhead swath height is less than said nominal printhead swath height by between 10 microns and 20 microns, then a compensation factor used to modify said nominal media advance distance is set to −15 microns.

33. A printing system, comprising:

a computer executing instructions for formatting image data; and an ink jet printer communicatively coupled to said computer, said ink jet printer including a controller communicatively coupled to a printhead, said printhead including a printhead memory having stored therein a printhead swath height correction value, said controller executing process steps to retrieve said printhead swath height correction value from said printhead memory and to forward said printhead swath height correction value to said computer, said computer modifying a format of said image data for use when printing with said printhead.

* * * * *